United States Patent [19]

Ashton et al.

[11] 4,302,092

[45] Nov. 24, 1981

[54] DRUM PROCESSING APPARATUS

[75] Inventors: George W. Ashton; Peter Manning; Horace G. Lee, all of London, England

[73] Assignee: Paterson Products Limited, London, England

[21] Appl. No.: 81,169

[22] Filed: Oct. 2, 1979

Related U.S. Application Data

[63] Continuation-in-part of Ser. No. 821,987, Aug. 5, 1977, abandoned.

[30] Foreign Application Priority Data

Aug. 11, 1976 [GB] United Kingdom ..... 33409/76

[51] Int. Cl.[3] ..... G03D 3/08

[52] U.S. Cl. ..... 354/307; 354/329; 134/121; 134/161; 366/219; 366/225

[58] Field of Search ..... 354/307, 312, 323, 328, 354/329, 330, 331, 297; 134/117, 118, 119, 120, 121, 156, 161; 366/55, 144, 166, 219, 220, 225, 228, 230, 240

[56] References Cited

U.S. PATENT DOCUMENTS

| | | | |
|---|---|---|---|
| 395,680 | 1/1889 | Summerton | 366/219 |
| 750,621 | 1/1904 | Dorr | 354/329 |
| 2,076,163 | 4/1937 | Ryan et al. | 366/225 |
| 2,947,236 | 8/1960 | Siegel | 354/307 |
| 3,276,751 | 10/1966 | Svensson et al. | 366/225 |
| 3,528,760 | 9/1970 | Buechner | 354/329 |
| 3,668,997 | 6/1972 | Ratowsky | 354/323 |
| 3,682,080 | 8/1972 | Merz | 354/330 |
| 3,698,307 | 10/1972 | Reichardt | 354/312 |
| 3,703,860 | 11/1972 | Wilkinson | 354/312 |
| 3,709,138 | 1/1973 | Brasher | 354/329 |
| 3,856,395 | 12/1974 | Comstock | 354/312 |
| 3,977,876 | 8/1976 | Ratowsky | 354/329 |
| 3,981,488 | 9/1976 | Ratowsky | 354/329 |
| 4,035,818 | 7/1977 | King | 354/323 |

FOREIGN PATENT DOCUMENTS

| | | | |
|---|---|---|---|
| 2514618 | 10/1975 | Fed. Rep. of Germany | 354/329 |

*Primary Examiner*—L. T. Hix
*Assistant Examiner*—Alan Mathews
*Attorney, Agent, or Firm*—Darby & Darby

[57] ABSTRACT

The invention relates to drum processing apparatus for in the treatment of photographic material. The apparatus comprises a stand, a processing drum rotatably mounted on the stand, and means for intermittently axially displacing processing liquid in the drum causing the liquid to oscillate axially in waves traversing the length of the drum. The drum is axially slidable relative the support. During rotation of the drum, it is variably axially displaced against drum biasing means to cause processing liquid in the drum to oscillate axially. The present apparatus, which is simple and convenient to construct, ensures uniform and continuous contact of the processing liquid over the photographic material treated in the drum.

6 Claims, 5 Drawing Figures

DRUM PROCESSING APPARATUS

The present application is a continuation-in-part of the earlier application Ser. No. 821,987 filed on Aug. 5, 1977, now abandoned.

This invention relates to a drum processing apparatus for use in the treatment of photographic material with processing liquid.

A wide variety of drum processing devices are known for the development of photographic paper, film, and other materials. Such apparatus generally consists of a drum within which a sheet of photographically sensitized material may be placed. The ends of the drum are at least partly closed to make them light-tight but at the same time are constructed to permit processing liquid to be introduced into the drum. With the drum horizontal or substantially horizontal, the liquid spreads out along the length of the drum and, as the drum is rotated, flows over the entire surface area of the photographic material. Such drum processing systems have the advantage that small quantities of processing liquid are used which is not only economic but makes process control easier, particularly as regards obtaining consistent results and constant temperature conditions.

One problem with drum processors is to ensure that the small amount of processing liquid is in practice evenly spread over the surface of the material to be treated. Even quite small departures from horizontality would make the processing liquid collect at one end of the drum, and the photographic material at the other end would consequently be undertreated or untreated. A wide variety of proposals have accordingly been made for introducing an even distribution of liquid within the drum and agitating it over the photographic material. Such proposals include oscillating the drum about various points along its length and reciprocating the drum axially. Many such proposals are constructionally complex and materially increase the cost of the apparatus.

It is the object of the present invention to provide drum processing apparatus for use in the treatment of photographic material which is comparatively simple in construction and therefore comparatively low in cost of manufacture and in use causes waves to be generated in a bead of processing liquid in the drum. The waves in the drum ensure that there is good and continuous contact of the processing liquid over photographic material treated in the drum.

According to a first feature of the present invention, a drum processing apparatus is provided comprising a stand, a processing drum supportable on the stand for rotation about its longitudinal axis and slidable axially, a spring biasing the drum axially, and a manual crank attached to the drum for simultaneously rotating the drum and imparting naturally generated, axially oscillatory motion to the drum against the restoring force of the spring.

It is found that when the crank handle is turned to rotate the drum by hand, variable axial forces or impulses are inherently generated by the manual rotation. These axial forces are counteracted by the spring such that the drum oscillates along its longitudinal axis while it is rotated. It is in fact quite difficult to turn the crank handle in such a fashion that no axial forces are generated. The axial oscillation of the drum causes liquid inside the drum to oscillate in travelling waves which traverse the material being processed therein.

In a second form of the invention, the drum contains preferably, at one or both ends, a member which acts upon rotation to cause axially directed waves to arise in a bead of processing liquid in the bottom of the drum to cause such processing liquid to flow over material being processed therein. Thus, this second form of the drum processing apparatus of the invention comprises a stand, a drum rotatably mounted on the stand, means for rotating the drum about a horizontal axis, and means provided within the drum including one or more members acting upon rotation of the drum to cause axially directed waves to arise in a bead of processing liquid located in the bottom of the drum to cause such processing liquid to flow over material being processed therein.

A wide variety of members may be used to effect this, for example, a series of short angled ribs on the side of the drum or an angled blade or other protrusion mounted on the end of the drum on the interior. In the preferred embodiment, a member asymmetric with respect to the axis of the drum acts, as the drum is rotated with a quantity of processing liquid therein, to cause in the liquid periodic waves travelling away from the end of the drum across the length of the drum, and so cause the processing liquid inside the drum to make good contact with the photographic sensitized material being developed in the drum. This member may also form all or part of a light-tight closure for the end of the drum.

In a particularly preferred embodiment of the invention, the processing drum is supported on the stand at one end by means of a hollow tube which is set in an axial cylindrical light-tight aperture in one end wall of the drum, the end of the tube exterior to the drum being in the form of a funnel and the end of the tube within the drum being in fluid communication with the interior of the drum but without permitting entry of light. Such a construction has the advantage that filling the drum may be effected while rotating it thus minimizing the risk of uneven treatment to the photographic material inside the drum. Suitably the other end of the drum is then supported on the stand by means of a dog which engages an axial light-tight aperture in the end wall of the drum, the dog being connected to drive means for the drum.

The stand in which the present processing drums are mounted may be a conventional rigid-membered stand, and preferably the drum is supported in a water bath since this aids temperature control.

The invention is illustrated by way of example with reference to the accompanying drawings, in which.

Figure 1:
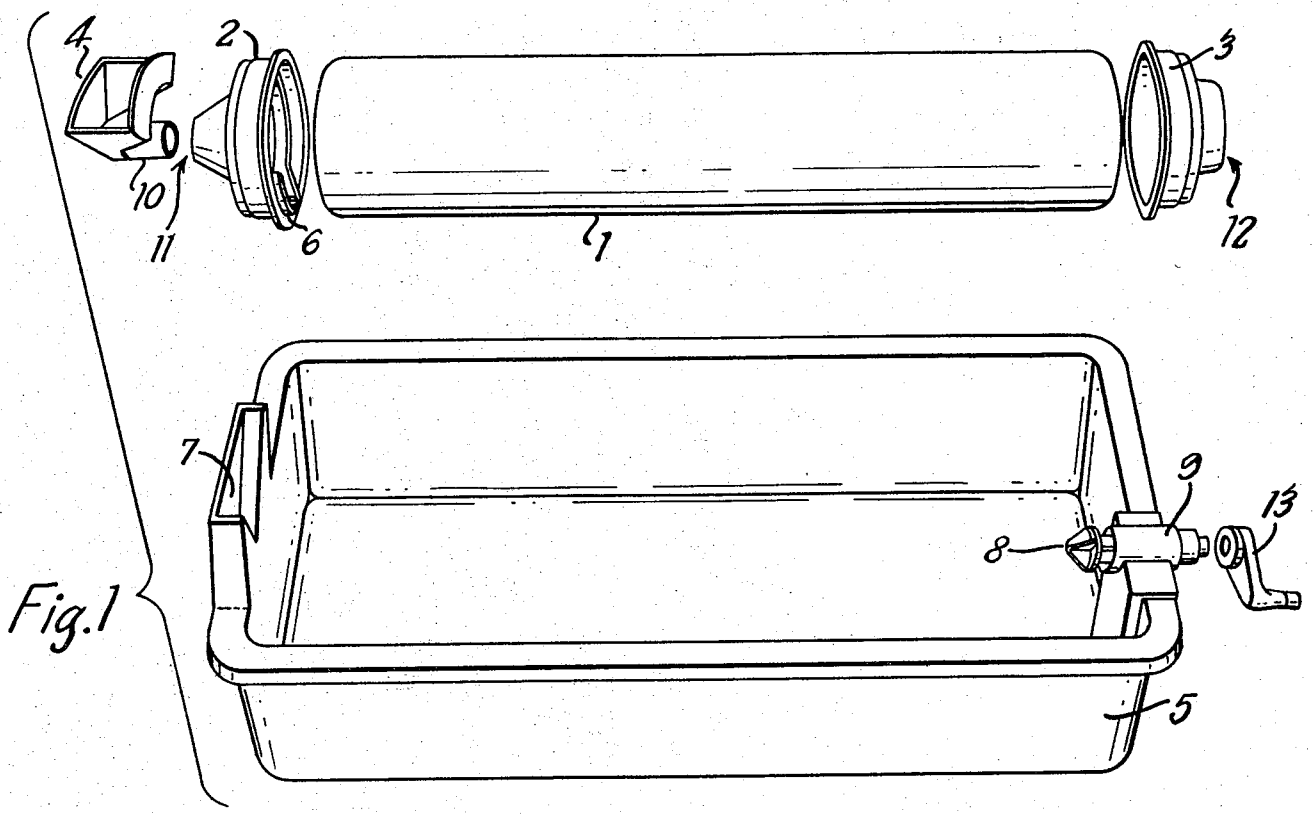
FIG. 1 is an exploded view of a manually driven, drum processing apparatus according to the present invention.

with reference to FIG. 1, the drum processing apparatus comprises a hollow, cylindrical drum 1 having two light-tight end caps, a fill cap 2 and a drain cap 3, a funnel 4, and a water bath 5. The fill cap 2 is fitted with an asymmetric member 6 (shown in more detail in FIGS. 2 and 3).

In use the drum 1 is supported in the water bath 5 between funnel 4, which engages a funnel cradle 7 in one wall of water bath 5, and a spring-biased dog 8 of a drive unit 9 on the opposing wall of water bath 5. The funnel 4 has a horizontally extending spout 10 which passes into a central aperture 11 in fill cap 2 which is fitted on drum 1 such that liquid poured into the top of the funnel 4 passes along the horizontal spout 10, through the aperture in end cap 2 and flows into the interior of drum 1 while at the same time drum 1 (and end cap 2) is able to rotate about the horizontal spout 10. (This is discussed in more detail below.) At the other end of the drum, the spring-biased dog of drive unit 9 engages the central light-trapping aperture 12 of end cap 3 fitted on drum 1. Thus the drum 1 is supported in the water bath 5 between the funnel 4 and dog 8. By means of the drive unit 9, the drum 1 is caused to rotate about its horizontal axis. In FIG. 1 there is shown a crank handle 13 which is fitted to drive unit 9 to enable it to be drivn. However, it will be appreciated that the drive unit 9 could also, for example, be motor driven.

Figure 2:
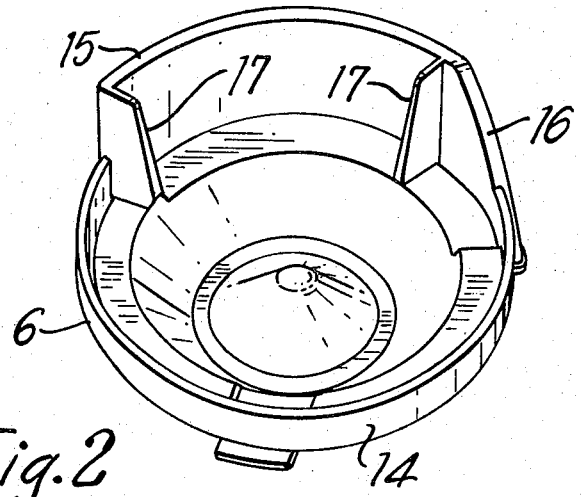
FIG. 2 is a perspective view showing in detail an asymmetric member for use in a drum processing apparatus according to the invention, for example, as shown in the left hand end of the drum of FIG. 1.

The asymmetric member 6 fitted in the end cap 2 of FIG. 1 is shown in more detail in FIG. 2. This member is circular in section but is not symmetric about its central axis. Thus the member 6 comprises a peripheral extending lip 14 which along part 15 of its length is of increased height. This part 15 is provided with an inclined face 16 and inwardly radially protruding fins 17.

Figure 3:
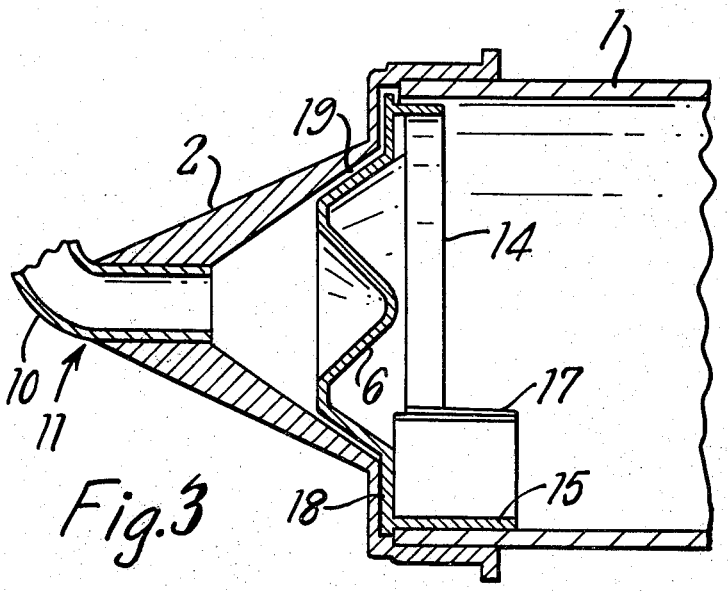
FIG. 3 is a diagrammatic cross-section of the asymmetric member shown in FIG. 2.

FIG. 3 shows a diagrammatic cross-section of the asymmetric member 6 in the left hand end of the drum of FIG. 1 nested within the end cap 2. The fill cap 2 is fitted over the end of the drum 1, and into the central aperture 11 of cap 2 extends the horizontal spout 10 of funnel 4 (for the sake of simplicity the remainder of funnel 4 is omitted from FIG. 3) such that drum 1 (and cap 2) can rotate about spout 10. Fitted inside cap 2 is the asymmetric member 6. The member 6 is secured to cap 2 by cementing around part of its circumference, for example, as shown at 18, but part of the circumference is left uncemented to leave open a passage, such as at 19, to allow liquid from funnel 4 and via spout 10 to enter the drum 1. The member 6 also ensures that the aperture 11 in cap 2 is light tight. The lip 14 and fins 17 of member 6 extend into drum 1.

In use the photographic sheet material to be processed is placed in the dark around the inside of drum 1 in a conventional manner, and the light-tight end caps 2 and 3 are fitted, and the drum is supported in the water bath 5 between funnel 4 and drive unit 9 as discussed above. The water in the water bath is suitably maintained very slightly above the required processing temperature. If this water bath contains a sufficient volume of water, this will generally mean that the processing temperature can be maintained long enough to make further adjustments unnecessary. Also the water bath may be used to hold stock solutions of processing liquids in bottles so that these also are held at the required temperature.

The drum 1 is rotated by means of turning crank handle 13 (or some other drive means), and the required processing liquid is added to funnel 4 from whence it passes via spout 10 and passage 19 into drum 1 to form a shallow pool of liquid in the bottom of the drum. The member 6 is cemented to end cap 2 and thus fixed with respect to the drum 1. Thus as drum 1 rotates so will member 6. As can be seen from FIG. 3 the lip 14 is in contact with the wall of drum 1 over only part of its periphery and is out of contact therewith over the remainder. Further, the extent to which lip 14 extends into drum 1 varies, it being greatest at 15. Thus, as the drum 1 and member 6 rotate, the bead of processing liquid at the end of the drum is displaced by means of the lip 14, the inclined face 16, and fins 17 and travelling waves are caused to move across the body of processing liquid. In this way the processing liquid is contacted well with the material to be processed on the inside of the drum. For proper operation of the processing liquid the drum 1 should be turned clockwise, i.e., so inclined face 16 is leading in the rotation of the member 6.

The rotation is continued for the required processing time. Then the drum is removed from the water bath 5 by simply pulling dog 8 out from end cap 3 and lifting the drum out conveniently together with funnel 4. The processing liquid can then be poured out of the drum 1 through drain cap 3. Further processing treatments can then be carried out or the photographic material removed or replaced as required.

Figure 4:
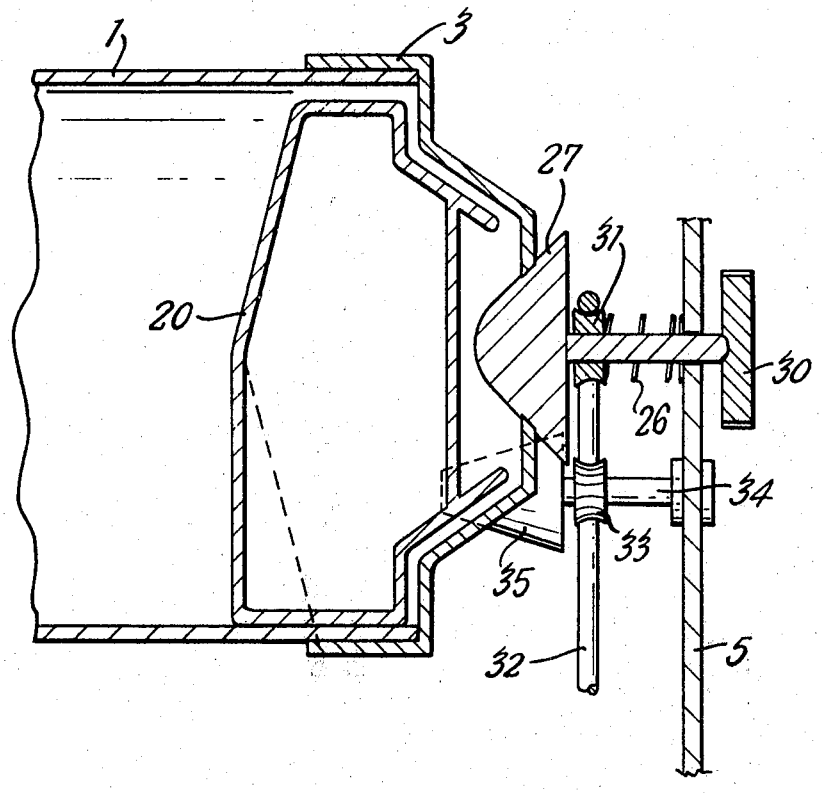
FIG. 4 is a diagrammatic cross-section of a right hand end of a mechanically driven drum processing apparatus according to the invention, for example, such as may be used in lieu of the right hand end of the drum shown in FIG. 1.

FIG. 4 shows a modified embodiment of the apparatus of FIGS. 1 to 3. In this embodiment an asymmetric member 20 is provided in the right hand end of the drum 1. Accordingly, in this modification there is no need to include an asymmetric member in the fill cap 2. Member 20 also forms part of the light-tight closure for the end of the drum shown in FIG. 4. The right hand end of drum 1 is provided with an end cap 3 which is engaged by a supporting dog 27. Inside the right hand end of drum 1, fixed in position with respect to the drum 1, is the member 20. Member 20 is in contact with the wall of drum 1 about only part of its periphery and is out of contact therewith about the remainder. The extent of the periphery of member 20 in contact with the wall of drum 1 may vary widely. Generally contact over a peripheral region of 90° to 120° is found to be satisfactory. Member 20 may take a very wide variety of shapes, but the essential feature of the construction is the formation of an eccentric protrusion from the end of the drum. Thus again when the drum is rotated and the member 20 with it, waves are formed in the bead of processing liquid in the drum travelling in an axial direction to ensure substantially uniform contact of the processing liquid with material to be processed around the inside walls of the drum.

FIG. 4 also illustrates a modified form of support and drive for the drum from the embodiment shown in FIG. 1. In FIG. 4 the crank handle 13 is replaced by a cog 30 which is driven by a suitable electric motor (not shown). Mounted on the shaft connecting cog 30 and dog 27 is a pulley 31 around which a drive belt 32 passes. Drive belt 32 is a continuous loop which also passes around two pulleys 33, a little lower than pulley 31 and laterally spaced from one another, and a bottom pulley (not shown). The pulleys 33, one of which is illustrated in FIG. 4 extending behind the end cap 3, and the other being understood to be even with the first but on the front side of end cap 3, are supported on freely rotatable shafts 34, the ends of which bear support bushes 35. Each bush 35, suitably made of high friction material such as rubber, engages a conical portion of end cap 3 and assists in supporting the drum. Additionally, as cog 30 is rotated, pulley 31 rotates and, via the drive belt 32, pulleys 33 are also rotated thus driving bushes 35 and causing drum 1 to rotate. As the drum is rotated, the processing liquid in the base of the drum is displaced by member 20 to form travelling waves over the length of the drum 1.

As noted above, although not shown in FIG. 4, the drive belt 32 goes around a bottom pulley mounted on a shaft likewise freely rotatably mounted. This shaft bears an impeller blade and accordingly stirs the water in the water bath to maintain a desirable circulation in the water.

In practice, a preferred rotational speed for the drum processing apparatus of the invention, such as shown in FIG. 4, for example, is about 40 to 75 r.p.m. At these speeds, the rhythmical wave formation in the processing liquid by the asymmetric member 6 results in standing waves being formed on liquid over the length of the drum. This movement results in an even and continuous contact of the processing liquid over the entire surface of the processing liquid in the drum, thus producing a desired uniform photographic development in all areas of the material.

Figure 5:
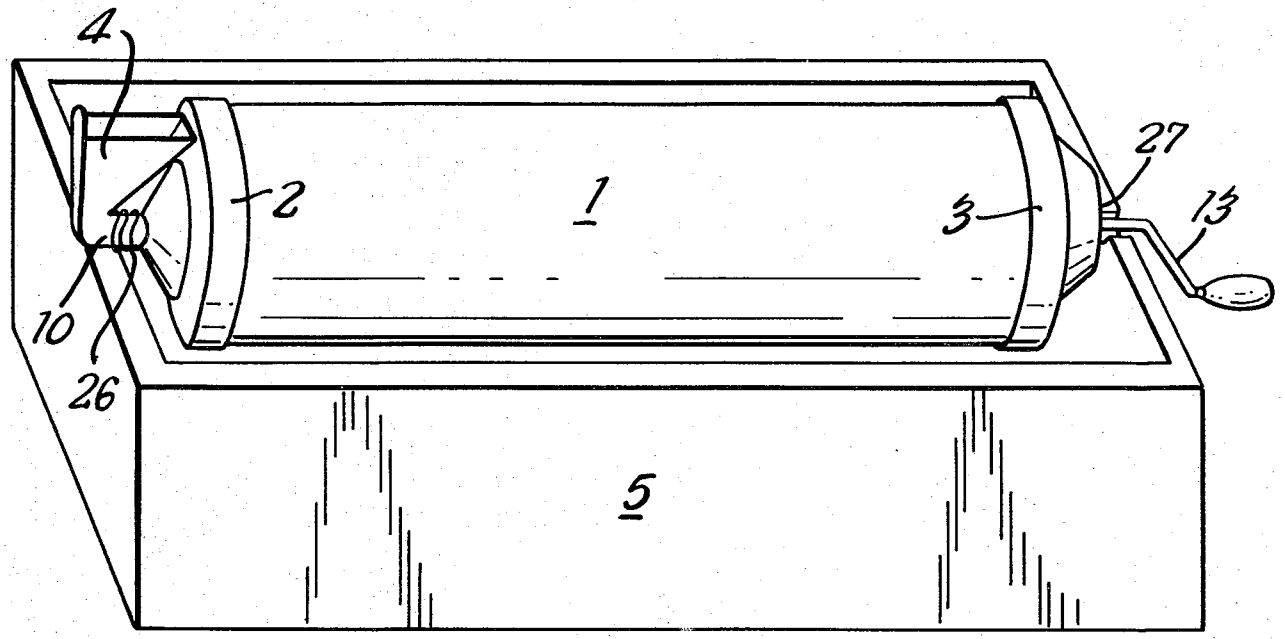
FIG. 5 is a perspective view of a drum processing apparatus according to another embodiment of the present invention.

FIG. 5 shows another embodiment of the drum processing apparatus according to the invention. In this embodiment axial displacement of processing liquid is provided by the axial oscillation of the drum induced by means of the axial impulses naturally generated simultaneously with rotation of a manual crank. Referring to FIG. 5, a drum 1 having end caps 2 and 3 is rotatably supported in a water bath 5. The left-hand end of the drum is supported via a funnel 4 which engages the wall of water bath 5 and which has a horizontally extending spout 10 passing into a central light-tight aperture in end cap 2. If liquid is poured into the top of funnel 4, it passes along the horizontal spout 10 through the end cap 2 and flows out into the interior of the drum 1. A spring 26 surrounds the spout 10 and elastically biases the drum 1 to the right by means of its being compressed between the end cap 2 of the drum and the wall of water bath 5.

At the right-hand end of the drum 1, the end cap 3 is engaged by a supporting dog 27 which is mounted on one end of a crank handle 13. The crank handle 13 is set on the side wall of water bath 5 in a suitable mounting. The end cap 2 can rotate on the spout 10 of funnel 4 and can also slide axially with respect thereto. By suitably choosing the dimensions of the components and the strength of spring 26 it can be ensured that when crank handle 13 is turned manually, the variable axial impulses inevitably generated by the manual rotation of the handle oscillates the drum axially against the restoring force of the spring 26. The axial oscillation of the drum thus results in the oscillatory movement of processing liquid evenly over the entire surface of the photographic material in the drum 1.

In the embodiments illustrated in FIGS. 4 and 5, the drum 1 may be removed from the water bath 5 in a manner similar to that of FIG. 1 simply by pulling the dog 27 out from the end cap 3 and lifting the drum out conveniently together with the funnel 4, which can then be removed axially from the end cap 2. The dog 27 may engage the end cap 3 by friction, but it is preferred to provide both the dog 27 and the end cap 3 with suitably interengaging parts. For example, dog 27 may be in the general form of a cone having four ribs, and the aperture in end cap 3 may be generally circular with four recesses for reception of the four ribs as shown, for example, on the dog 8 in FIG. 1. In order to ensure that the water bath 5 in the illustrated embodiments is set up horizontally, it may bear an appropriate marking or have an appropriate horizontally extending feature with which the water level may be aligned. This is important in order to ensure that drum 1 is equally immersed along its length.

The above-described embodiments are illustrative of the invention and do not encompass all the possible modifications and variations of the invention. All such modifications and variations are included within the spirit and scope of the invention as defined in the following claims.

We claim:

1. A drum processing apparatus comprising a support, a processing drum for containing processing liquid therein mounted on the support for rotation about its longitudinal axis and axially slidable relative the support, means biasing the drum axially, and manual driving means at one end of the drum for rotating the drum about its longitudinal axis and axially displacing the drum during rotation, said manual driving means generating variable axial displacement forces against the restoring force of the biasing means during manual rotation which impart axial displacement motion to the axially slidable drum against the restoring force of the biasing means, said driving means and biasing means acting together to cause processing liquid in the drum to oscillate axially.

2. A drum processing apparatus comprising a stand, a processing drum having end walls mounted on the stand for rotation about its longitudinal axis and axially slidable, manual drive means for rotating the drum being connected to the drum so as to permit axially directed impulses from the driving means to be imparted to the drum during rotation thereof, and means biasing the drum axially, said driving means and biasing means acting together to cause processing liquid in the drum to oscillate axially, wherein the processing drum is supported on the stand at one end by means of a hollow tube which is set in an axial cylindrical light-tight aperture in one end wall of the drum, the end of the tube exterior to the drum being in the form of a funnel and the end of the tube within the drum being in fluid communication with the interior of the drum but without permitting entry of light.

3. A drum processing apparatus according to claim 2 wherein the other end of the drum is supported on the stand by means of a dog which engages an axial light-tight aperture in the end wall of the drum, the dog being connected to drive means for the drum.

4. A drum processing apparatus according to claim 1 wherein the support includes a water bath.

5. A drum processing apparatus comprising a support, a processing drum having a hollow cylindrical body including end walls for containing processing liquid therein and rotatably mounted on the support, driving means for rotating the drum about a longitudinal axis, means on the interior of the drum including a wave-generating member at one end of the drum responsive to rotation of the drum to create axially directed waves in a bead of processing liquid located at the bottom of the drum which flows over material being processed therein, one of said end walls having an axial cylindrical light-tight aperture, a hollow tube set in said aperture, said drum being rotatably supported at one end by means of said hollow tube, said tube having an exterior, funnel portion and a light tight, interior portion within the drum in fluid communication with the interior of the drum, the other end wall having a second axial light-tight aperture therein, a dog engaging said second aperture, the other end of the drum being rotatably supported by said dog, and means connecting said dog to said driving means.

6. A drum processing apparatus according to claim 5 wherein said wave-generating member is asymmetrical with respect to the longitudinal axis of the drum.

* * * * *